United States Patent [19]

Zimmer

[11] Patent Number: 4,602,826

[45] Date of Patent: Jul. 29, 1986

[54] EQUIPMENT HOUSING

[76] Inventor: Edward F. Zimmer, 6175 Jackson Rd., Ann Arbor, Mich. 48084

[21] Appl. No.: 673,194

[22] Filed: Nov. 19, 1984

[51] Int. Cl.[4] ..... A47B 81/06; F16B 12/00

[52] U.S. Cl. ..... 312/7.2; 312/108; 312/111; 312/263

[58] Field of Search ..... 312/7.2, 111, 108, 140, 312/263, 257 SK

[56] References Cited

U.S. PATENT DOCUMENTS

| | | | |
|---|---|---|---|
| 2,012,803 | 8/1935 | Baker | 312/263 |
| 3,432,216 | 3/1969 | Yang | 312/111 |
| 3,735,041 | 5/1973 | Fujita | 312/7.2 |
| 3,854,783 | 12/1974 | Teranishi | 312/108 |
| 3,901,571 | 8/1975 | Begitschke et al. | 312/263 |
| 3,918,781 | 11/1975 | Paris | 312/111 |
| 4,023,871 | 5/1977 | Dantzler | 312/111 |
| 4,171,150 | 10/1979 | Soderlund | 312/111 |
| 4,270,820 | 6/1981 | McMullan et al. | 312/263 |
| 4,379,604 | 4/1983 | Rock et al. | 312/111 |
| 4,474,416 | 10/1984 | Rogahn | 312/263 |

FOREIGN PATENT DOCUMENTS

| | | | |
|---|---|---|---|
| 1251681 | 10/1971 | United Kingdom | 312/263 |
| 2068214 | 8/1981 | United Kingdom | 312/7.2 |

*Primary Examiner*—Victor N. Sakran

*Attorney, Agent, or Firm*—Krass and Young

[57] ABSTRACT

An L-shaped molded plastic panel which is adapted to be joined with three similar L-shaped panels to form the respective side walls of a rectangular tubular housing. Each panel comprises a first rectangular planar panel portion having a relatively long length; a second rectangular planar panel portion, having a relatively short length and substantially the same width of the first panel portion, formed integrally with the first panel portion and extending normally from one edge of the first panel portion; a first joinder structure formed along the free edge of the first rectangular planar portion; and second joinder structure formed along the free edge of the second rectangular planar portion and having a configuration disparate from the first joinder structure but matingly and interlockingly complementary to the first joinder structure so that four of the panels may be joined together with the first joinder structure on a first panel portion of one panel matingly coacting with the second joinder structure on a second panel portion of an adjacent panel to matingly interlock the panels together to form a rectangular tubular housing.

5 Claims, 9 Drawing Figures

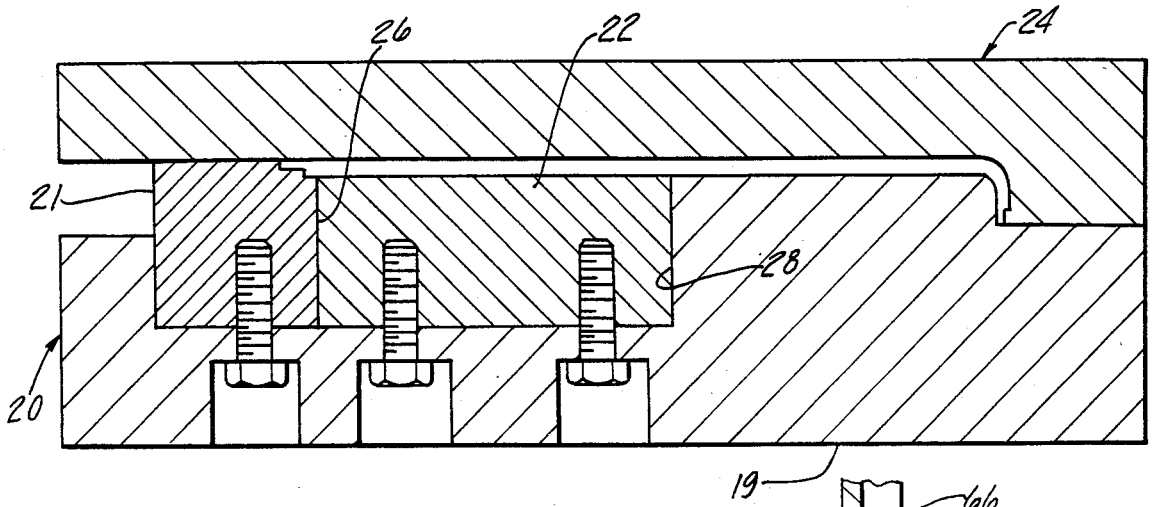
Fig-5
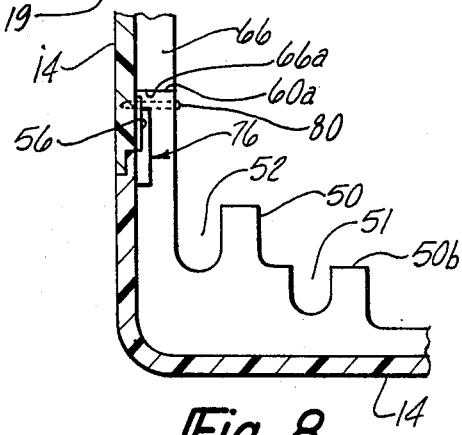
Fig-8
Fig-6
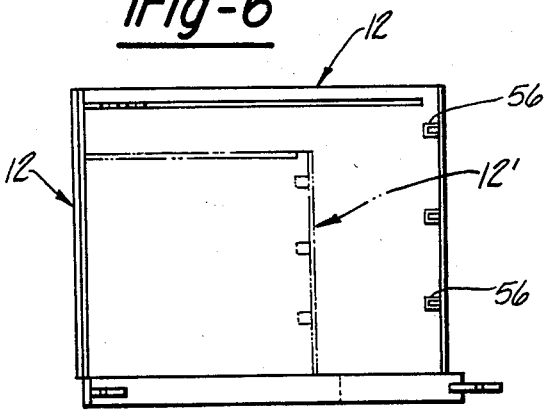
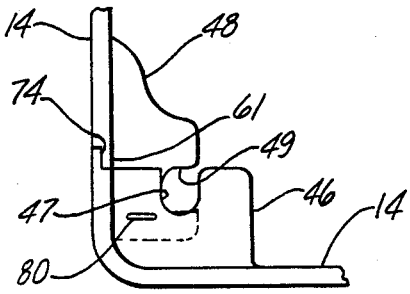
Fig-7
Fig-9
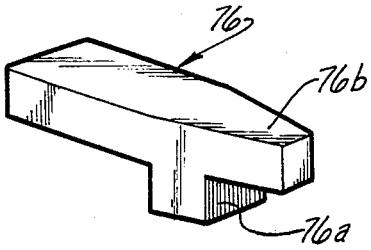

EQUIPMENT HOUSING

BACKGROUND OF THE INVENTION

This invention relates to equipemt housings and more particularly to housings adapted to receive electronic equipment such as cathode ray tube display terminals.

The housings for electronic equipment such as cathode ray tube display terminals are typically formed of molded plastic. Typically, four or five sides of the housing are molded as a single integral unit with the front open to receive the CRT. In general, the cost of a die for injection molding plastic parts increases exponentially as the depth or third dimension of the die increases. Accordingly, the cost of a metal die to mold an enclosure large enough to house a CRT display terminal and its associated electronics is substantial. The cost of such a large die is also increased by the necessity of molding all five sides at once, especially since such enclosures generally require complex moldedin shapes on at least some of the walls. In an attempt to reduce the cost of the dies for injection molding housings for CRT display terminals, it has been proposed to form the housing of two U-shaped halves fitted together in the manner of a clam shell. Whereas this approach reduces die cost somewhat, the die cost is still substantial because the die depth remains substantial.

SUMMARY OF THE INVENTION

The present invention is directed to a housing for electronic equipment in which the housing is formed of a plurality of identical relatively small panels which are joined together to form the final housing. Specifically, the invention provides an L-shaped molded plastic panel which is adapted to be joined with three similar L-shaped panels to form the respective side walls of a rectangular tubular housing. Each panel according to the invention comprises a first rectangular planar panel portion having a relatively long length; a second rectangular planar panel portion, having a relatively short length and substantially the same width of the first panel portion, formed integrally with the first panel portion and extending normally from one edge of the first panel portion; a first joinder means formed along the free edge of the first rectangular planar portion; and second joinder means formed along the free edge of the second rectangular planar portion and having a configuration disparate from the first joinder means but matingly and interlockingly complementary to the first joinder means so that four of the panels may be joined together with the first joinder means on a first panel portion of one panel matingly coacting with the second joinder means on a second panel portion of an adjacent panel to matingly interlock the panels together to form a rectangular tubular housing. The matingly interlockingly complementary joinder means on the adjacent panels may comprise, for example, a series of grooves and ribs which coact to interlock the panels.

The invention arrangement allows the use of relatively shallow, relatively inexpensive metal dies to form the relatively small parts which are joined together to form the housing, and the invention arrangement also provides great versatility with respect to the variety of shapes and sizes of housings that can be produced from a relatively small number of dies. For example, a square cross-section housing may be produced by utilizing a single die to produce four identical L-shaped panels; the top and bottom panels may be lengthened to produce a relatively squat housing; or the side panels may be lengthened to produce a relatively tall housing.

According to a further feature of the invention, the die for producing the L-shaped panels is arranged to accommodate insertable die parts which may be added or substracted from the die to produce a wide variety of sizes of L-shaped panels from the same basic die. By selective insertion and removal of inserts, one relatively small inexpensive die may be used to produce a variety of sizes of L-shaped panels and the L-shaped panels in the varying sizes thus produced, may be combined together to produce a wide variety of housing sizes and shapes.

BRIEF DESCRIPTION OF THE DRAWINGS

FIGS. 4 and 5 are cross sectional views taken on lines 4—4 and 5—5 respectively of FIG. 3 and showing the male or core die member in palce over the female or cavity die member;

FIG. 6 is a plan view of an L-shaped panel according to the invention showing two of the alternative sizes which may be produced by selective reconfiguration of the die of the invention;

FIGS. 7 and 8 are fragmentary views taken on lines 7—7 ad 8—8 of FIG. 1 respectively; and FIG. 9 is a view of a finger used in the assembly of the panels.

DETAILED DESCRIPTION OF THE PREFERRED EMBODIMENT

Figure 1:
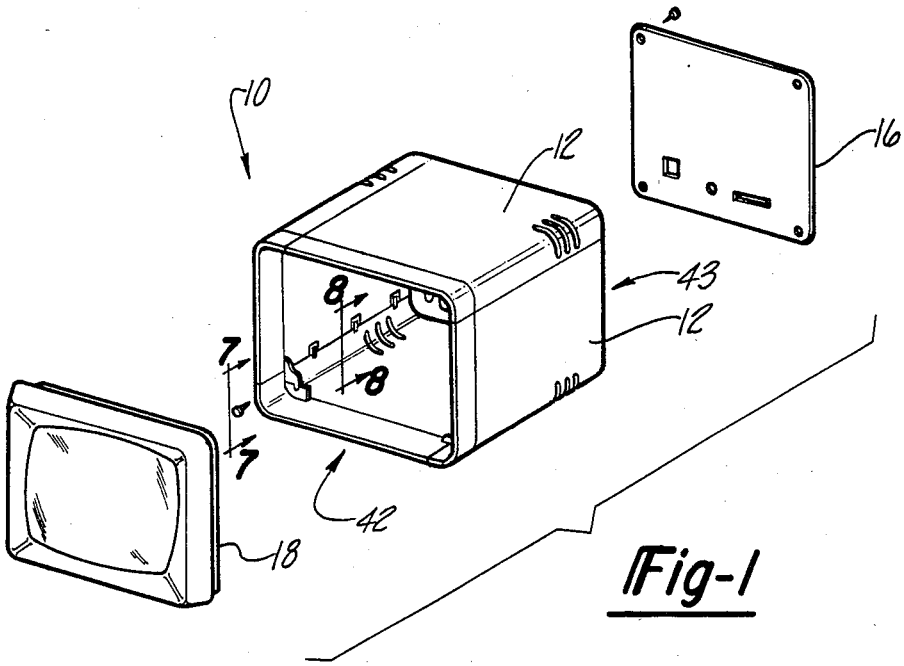
FIG. 1 is a perspective partially exploded view of an invention housing assembled from four identical L-shaped panels, a front bezel, and a back panel.

The invention housing comprises a molded tubular, equipment housing 10 formed by joining together four molded L-shaped panels 12. The housing is completed by a front bezel 18 adapted to fit over the front opening of the tubular housing and a back panel 16 adapted to close the back opening of the housing.

The molded panels 12 have a generally L-shaped configuration and include a first rectangular planar panel portion 14 having a relatively long length and a second rectangular planar panel portion 13 having a relatively short length. Panel portions 13 and 14 have the same width, and panel portion 13 is formed integrally with panel portion 14 and extends normally from one edge of panel portion 14 to form the L configuration of the panel. The forward edge portions of panel portions 13 and 14 are stepped inwardly at 15 to form forward flange portions 13*a* and 14*a*.

Figure 2:
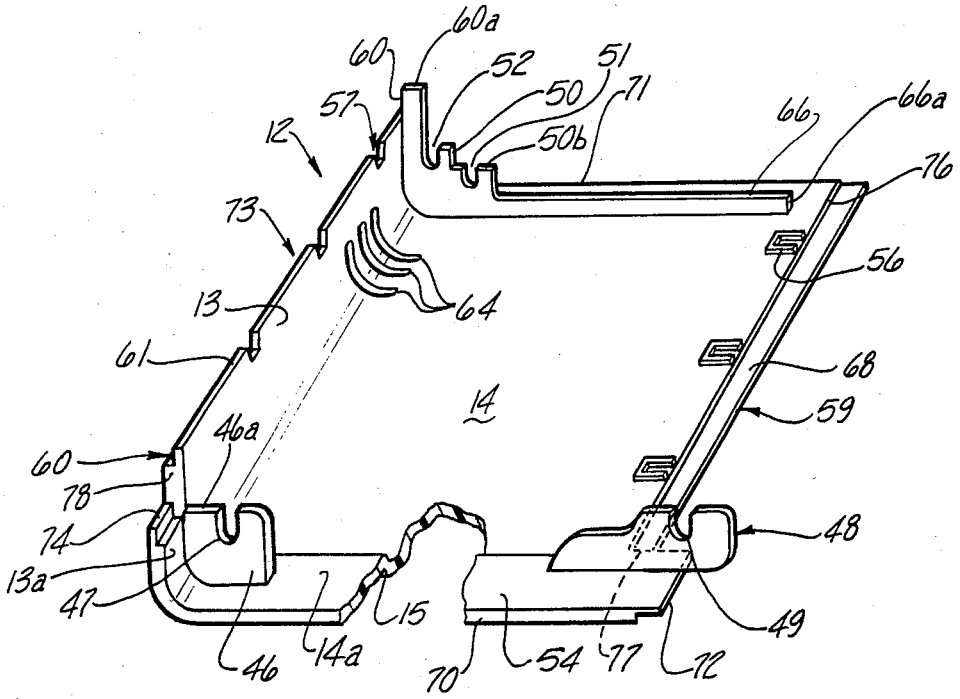
FIG. 2 is a perspective view of one of the L-shaped panels forming the housing of FIG. 1.

A rib or gusset 46 is formed adjacent the front of the panel at the inside juncture of, and integral with panel portions 13*a* and 14*a*. Rib 46 is parallel to and set back from the front edge 70 of the panel portion 14 and includes a slot 47 opening in the upper edge 46*a* of the rib. Another gusset or rib 48 extends integrally upwardly from the inner surface of panel portion 14*a*. Rib 48 extends parallel to rib 46 and extends beyond the lateral side edge 59 of panel portion 14. The front surface of rib 48 is spaced substantially the same distance from front edge 70 of panel portion 14 as the rear surface of rib 46. A slot 49 is provided in rib 48 and opens in the upper edge 48*a* of the rib. Another gusset or rib 50 is formed adjacent the rear of panel 12 integral with and at the inside juncture of panel portions 13 and 14. Rib 50 is formed parallel to ribs 46 and 48 and includes an upper slot 52 opening in the upper edge 50*a* of rib 50 and a lower slot 51 opening in a stepped down portion 50*b* of the upper edge of rib 50. Rib 50 is set in a small distance from back edge 71 of panel portions 13 and 14 and extends integrally upwardly, as viewed in FIG. 2, to form a tab 60. Rib 50 also extends across the rear edge of panel portion 14 in the form of a raised bead 66. The rear face of rib 50, tab 60, and bead 66 are aligned and spaced uniformly from panel rear edge 71.

Lateral side edge 59 of panel portion 14 is cut away along the main body of panel portion 14 to form a lower lip 68 and is oppositely cut away along flange portion 14*a* to form an upper lip 72 which is stepped outwardly at 77 relative to lip 68. The lateral side edge 73 of panel portion 13 is cut away along the main body portion of panel portion 13 to form an inner lip 61 and is oppositely cut away along flange portion 13*a* to form an outer lip 74 which is stepped downwardly at 78 relative to lip 61. A plurality of U-shaped bosses 56 are formed integrally on the inner surface of panel portion 14 adjacent the shoulder 76 formed at the juncture of lip 68 and panel portion 14 and a corresponding plurality of notches 57 are formed along the free edge of lip 61. Tab 60 extends upwardly above the free edge of lip 61 by a distance corresponding to the distance by which the end 66*a* of bead 66 is spaced from the shoulder 76. A plurality of slots 64 are molded into the inner corners of each panel to admit cooling air into a housing assembled from several panels.

To form a housing, four panels 12 are placed together as seen in FIG. 1. Thus assembled, and as best seen in FIGS. 7 and 8, lips 68 and 61, and 72 and 74, nest together in overlapping relation to inhibit side to side movement of the panels; steps 77 and 78 abuttingly engage to inhibit front to rear movement of the panels; the rib 48 of one panel is fitted immediately behind the rib 46 of the adjacent panel to further inhibit front to rear movement; and the end 66*a* of the bead 66 on one panel abuts the end 60*a*of the tab 60 on the adjacent panel to form a continuous flange or rim extending around the rear interior of the assembled panels. Following assembly, staples or tacks 80 are driven into and through back to back ribs 46,48 and through tabs 60 into the underlying surface of panel portion 14. The panels are now securely assembled. If desired, to discourage warping, one or more separate fingers 76 (FIGS. 8 ad 9) may be cemented into bosses 56 with finger pin portions 76*a* fitting in slots 57 and finger nose portions 76*b* overlying lip 61.

With ribs 46, 48 in abutting back to back relation, rib slots 47 and 49 are crossed with respect to one another to form a passage or opening closed on all four sides to accept a fastneing device such as a screw or a bolt. The screws or bolts passing through the closed openings formed by slots 46 and 49 may also pass through holes in the mounting ears of a CRT disposed within the housing and/or through suitable attachment means on front bezel 18 so that the same screws or bolts may serve to interlock adjacent panels, mount the CRT within the housing, and secure the front bezel in position over flange portions 13*a*, 14*a*. Alterátively, the bezel may be adhesively secured to flange portion 13*a*, 14*a*. Back panel 16 is positioned witin the rear opening of assembled panels 12 in abutting relationship to the continuous peripheral edge formed by ribs 50 and beads 66. The back panel is attached to the main housing by screws passing through holes in the back panel and through slots 51 or 52 in ribs 50. Two slots are provided in each rib 50 so that, if it is desired to provide a hinged panel opening at the rear of the housing, a lower fixed panel may be secured to the two lower ribs 50 of the assembled panels by use of the four slots provided in toto by these two lower ribs and an upper panel may be hinged to the top edge of the fixed lower panel.

Figure 3:
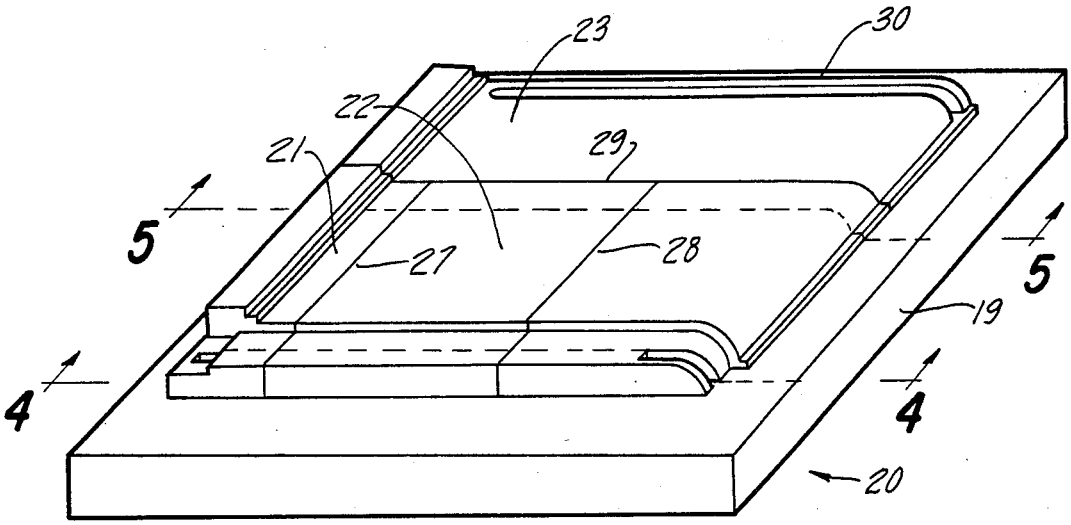
FIG. 3 is a perspective view of the male or core member of a die used in the formation of the L-shaped panels of the invention housing.
Figure 4:
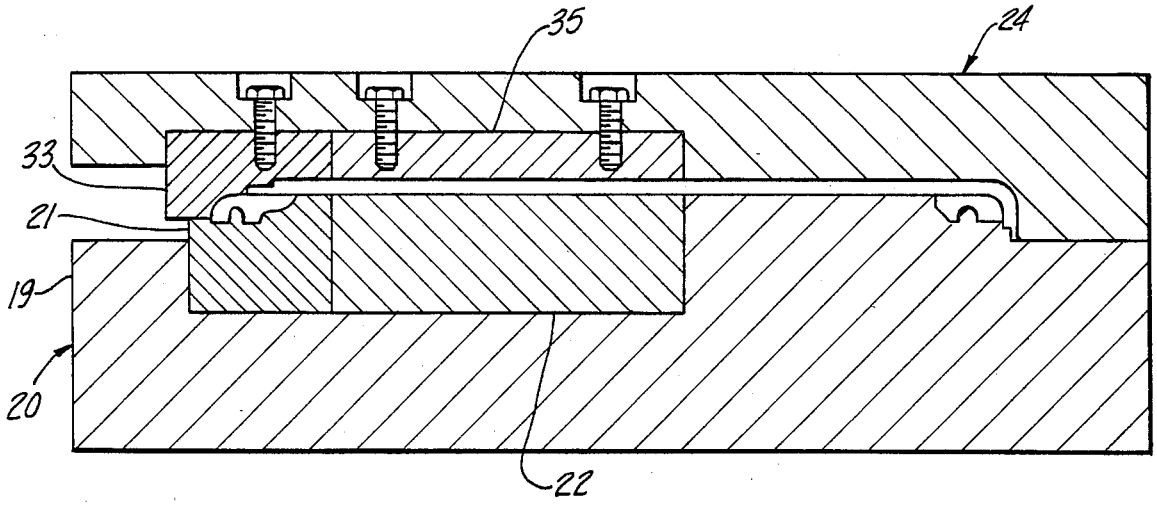

The die for forming panels 12 is seen in FIGS. 3, 4 and 5. The die, broadly considered, comprises a female member 24 and a male member 20. Male member 20 is an assembly comprising a base portion 19 and a plurality of inserts 21, 22 and 23. Die part 22 may be positioned as illustrated on base 19 to form a panel 12 having a relatively long panel portion 14. Alternatively, die part 22 may be omitted in which case die part 21 is positioned so that its edge 26 abuts edge 28 of die base 19. Since die part 21 forms edge 59 and gusset 48 of molded panel 12, omission of die part 22 reduces the length of panel portion 14 by an amount equal to the length of die part 22. As a further alternative, die part 21 may be positioned closer to edge 28 of base member 19 than the position illustrated, in which event the illustrated die part 22 would be replaced with a smaller die part (not shown) to fill the smaller space between edges 26 and 28. The latter arrangement will produce a panel 12 having a panel portion 14 with a length intermediate the length produced by the illustrated die configuration and the configuration when die part 22 is omitted entirely. Obviously, further alternative positions of die part 21 with respect to edge 28 will produce further variations in the length of panel portion 14 of panel 12.

Die part 23 forms the back edge 71, gusset 50 and bead 66 of the molded panel 12. The width of panel 12, that is the dimension of the panel between front edge and rear edge, may be varied by selectively varying the width of die part 23.

Female mold member 24 includes insertable die parts 33 and 35. The position of die part 33 on mold 24 and the length of die part 35 are chosen to correspond to the position of die part 21 on mold part 20 and the length of die part 22.

FIG. 6 illustrates an L-shaped panel 12 produced in the die of FIGS. 3 through 5. Also shown on FIG. 6, in dotted outline, is a smaller panel 12' produced by omitting die parts 22 ad 35 and substituting a smaller die part 23 for the die part 23 shown in the figures.

The invention housing presents a similar appearance no matter which panel is chosen as the bottom panel. Any one of the four panels may be interlocked to a suitable mounting base by fingers hooked around the cooling slots or by threaded inserts positioned in the chosen panel. This provides an advantage in CRT display terminal housings which may require the long dimension of the CRT face to be oriented in either a horizontal or a vertical direction.

The invention housing and method provide many important advantages. Since the housing is formed from four separate panels, the die to form the panels is relatively small and relatively inexpensive. Further, since the die is arranged with removable inserts in both dimensions, the same die may be utilized to form a plurality of panels having varying dimensions and the variety of panels produced by the invention die may in turn be used to produce a wide variety of housings having varying shapes and varying sizes.

Whereas a preferred embodiment of the invention has been illustrated and described in detail it will be apparent that various changes may be made in the preferred embodiment without departing from the scope or spirit of the invention.

I claim:

1. A rectangular tubular housing comprising four L-shaped molded palstic panels joined together to form the respective side walls of the housing, each panel comprsing:

(A) a first rectangular planar panel portion having a relatively long length;

(B) a second rectangular planar panel portion having a relatively short length and substantially the same side width as the first panel portion formed integrally with said first panel portion and extending normally from one side edge of said first panel portion;

(C) first joinder means formed along the free side edge of said first rectangular planar portion; and (D) second joinder means formed along the free side edge of said second rectangular planar portion and having a configuration disparate from said first joinder means but matingly interlockingly complementary to said first joinder means so that said panels may be joined together with the first joinder means on a first panel portion of one panel matingly coacting wit the second joinder means on a second panel portion of an adjacent panel to matingly interlock said panels together to form the rectangular tubular housing.

2. A housing according to claim 1 wherein:

E. said joinder means for each panel includes lip means extending along the free edge of one of said panel portions and complementary lip means defined along the free edge of the other panel portion and coacting with said lip means on said one panel portion of an adjacent panel, with the panels assembled, to inhibit relative side to side movement of the panels.

3. A housing according to claim 2 wherein:

F. said joinder means for each panel further includes a first rib formed on the inner surface of said panel at the inner juncture of said panel portions and a second rib formed adjacent said free edge of said first panel portion; and G. one of said ribs extends beyond its associated free panel edge and the rearward face of one of said ribs is spaced substantially the same distance from the lengthwise front edge of the panel as the forward face of the other rib so that, with the panels assembled, a first rib on one panel is disposed in overlapping and abutting front to back relation to a second rib on an adjacent panel to preclude relative front to back movement of the panels.

4. A housing according to claim 3 wherein:

H. the rib formed adjacent the free edge of said first panel portion extends beyond that free edge and is positioned behind the other rib on the adjacent panel in assembled relation of the panels.

5. A housing according to claim 3 wherein:

H. a slot is provided in each of said first and second ribs opening at the upper edge of that rib; and I. with the first rib of one panel positioned in front to back abutting relation to the second rib of an adjacent panel in the assembled relation of the panels, the slots in the respective ribs are crossed with respect to one another to form a closed opening for receipt of a suitable fastener element.

* * * * *